United States Patent [19]

Whitman

[11] Patent Number: 4,751,802

[45] Date of Patent: Jun. 21, 1988

[54] DEVICE FOR FACILITATING INSTALLATION OF RUBBER ROOF SHEETS

[76] Inventor: Robert E. Whitman, 1-2143 Sherwood La., Swanton, Ohio 43558

[21] Appl. No.: 857,494

[22] Filed: Apr. 30, 1986

Related U.S. Application Data

[63] Continuation-in-part of Ser. No. 764,101, Aug. 9, 1985.

[51] Int. Cl.[4] ..... E04D 5/14

[52] U.S. Cl. ..... 52/173 R; 52/410

[58] Field of Search ..... 428/40, 41; 411/82, 411/965; 52/408, 410, 173 R

[56] References Cited

U.S. PATENT DOCUMENTS

| | | | |
|---|---|---|---|
| 2,855,040 | 10/1958 | Gaines | 160/382 |
| 4,045,076 | 8/1977 | Day | 428/40 |
| 4,162,597 | 7/1979 | Kelly | 52/410 |
| 4,433,930 | 2/1984 | Cosenza | 411/82 |
| 4,467,581 | 8/1984 | Francovitch | 52/410 |
| 4,520,606 | 6/1985 | Francovitch | 52/410 |
| 4,574,551 | 3/1986 | Giannuzzi | 52/410 |
| 4,606,168 | 8/1986 | Fuhrer | 52/410 |

*Primary Examiner*—John E. Murtagh

*Attorney, Agent, or Firm*—George R. Royer

[57] ABSTRACT

The invention herein is directed to an apparatus used for the facilitating in the process of affixing rectangularly shaped sheets of rubber roofing material to the upper surface of a roof in which rectangularly shaped bonding plates are used to bond the rubber roof sheets to the upper roof surface. The invention relates to an integrated bonding plate apparatus wherein an adhesive material is layered in a flush manner to the upper bonding plate surface, with a layer of plastic or paper covering material attached in a flush manner over the top surface of said adhesive material so that said covering material can be easily removed just immediately prior to the process of installing the bonding plates either over or under the respective rubber roof sheet adjoining bonding plate surfaces. The adhesive material is thus adapted to cover conformingly the upper surface of the bonding plate once the bonding plate is fastened over the adjoining upper surface of the rubber roof sheet or under said roof sheeting, depending on whether the bonding plates are affixed above or below the rubber roof sheets.

3 Claims, 1 Drawing Sheet

DEVICE FOR FACILITATING INSTALLATION OF RUBBER ROOF SHEETS

BACKGROUND OF INVENTION AND DESCRIPTION OF PRIOR ART

The invention herein relates to an apparatus for helping to secure rectangularly shaped sheets of rubber roofing to the upper surface of a roof and is a continuation in part of my pending application Ser. No. 764,101, filed Aug. 9, 1985.

Roofing sheets comprised of rubber materials are now used more widely for roofing coverings because of the optimal life and durability. The usual approach is to place over the upper roof surface a grid-like pattern of fastening (bonding) plates, usually square-shaped members, dispersed over the upper roof surface and spaced relative to one another in a regular matrix-like pattern, generally four feet or more apart. The rubber roof sheets are, in turn, adhered in a flush manner to the upper surfaces of such fastening plates, using a suitable adhesive. In other applications the bonding plates are affixed over the top of the rubber roof sheets to hold the rubber roof sheets in a flush manner to the upper roof surface. The usual arrangement in using such fastening plates is a series of evenly-spaced rows and columns of such plates, regularly and symmetrically spaced as seen from an upper elevational view of such roof.

The present practice, as stated, is to disperse the fastening plates over the upper roof surface, using a spiking arrangement to adhere the plate to the roof surface. Once the plates are in place, they serve as the medium to which the rubber sheath is affixed by some appropriate intermediate adhesive material to affix the sheath to the upper surfaces of the bonding fastening plates. If the plates are affixed over the sheets, the same spiking arrangement is still used.

One of the predominant problems with using an adhesive intermediate material, such as a permanent glue, is that the labor or physical process of covering the bonding plate with the adhesive material is cumbersome, time-consuming and thus labor intensive in the process of placing such adhesive material on the bonding plate. Since labor costs are a substantial cost in the installation of any roofing system, any apparatus or method for saving such costs is important.

The subject invention is conceived to overcome such labor and cost problems in the installation process using rubber roof sheets and the following objects of the subject invention are set forth accordingly.

In view of the above, it is an object of the subject invention to provide an improved apparatus for affixing rubber roofing sheets to the upper surface of a roof;

Yet another object of the subject invention is to provide an improved bonding device in installing rubber roof sheets for covering roof structures;

Still another object of the subject invention is to provide an improved process for adhering and affixing rubber roof sheets to the upper surface of a roof;

Other and further objects will become apparent from a reading of the following description taken in conjunction with the claims.

DESCRIPTION OF GENERAL EMBODIMENT

The subject invention relates to the use of bonding fastening plates used for adhering a number of rectangularly shaped rubber roofing sheets to the upper surface of a roof. In the general embodiment of the subject invention, these bonding plates have integrally adhered to the upper surface thereof an integrally bonded adhesive material that serves as a protective covering and sealant over the bonding plate once affixed to either the top or bottom of the rubber roofing sheet. A strip of material is placed over the upper surface of the adhesive material over the bonding plate surface, which strip can be readily removed by simply peeling same off the upper surface of the bonding plate just immediately prior to the installation process.

DESCRIPTION OF PREFERRED EMBODIMENT

The subject invention centers on a physical apparatus for process of affixing a plurality of rubber roof sheets to the upper surface of a roof of any type of building structure. However, the preferred embodiment of the subject invention is most applicable to roof structures wherein the roof is horizontal, although it is not to be so limited. While the description below is explicitly directed to an application wherein the bonding plates are affixed over top of the rubber roof sheets, it will be understood that this invention is equally applicable to those circumstances where the bonding plates are affixed between the upper roof surface and the lower surface of the rubber roofing sheets. Moreover, description and application of the preferred embodiment is not to be considered as limiting the scope of the subject invention.

Figure 1:
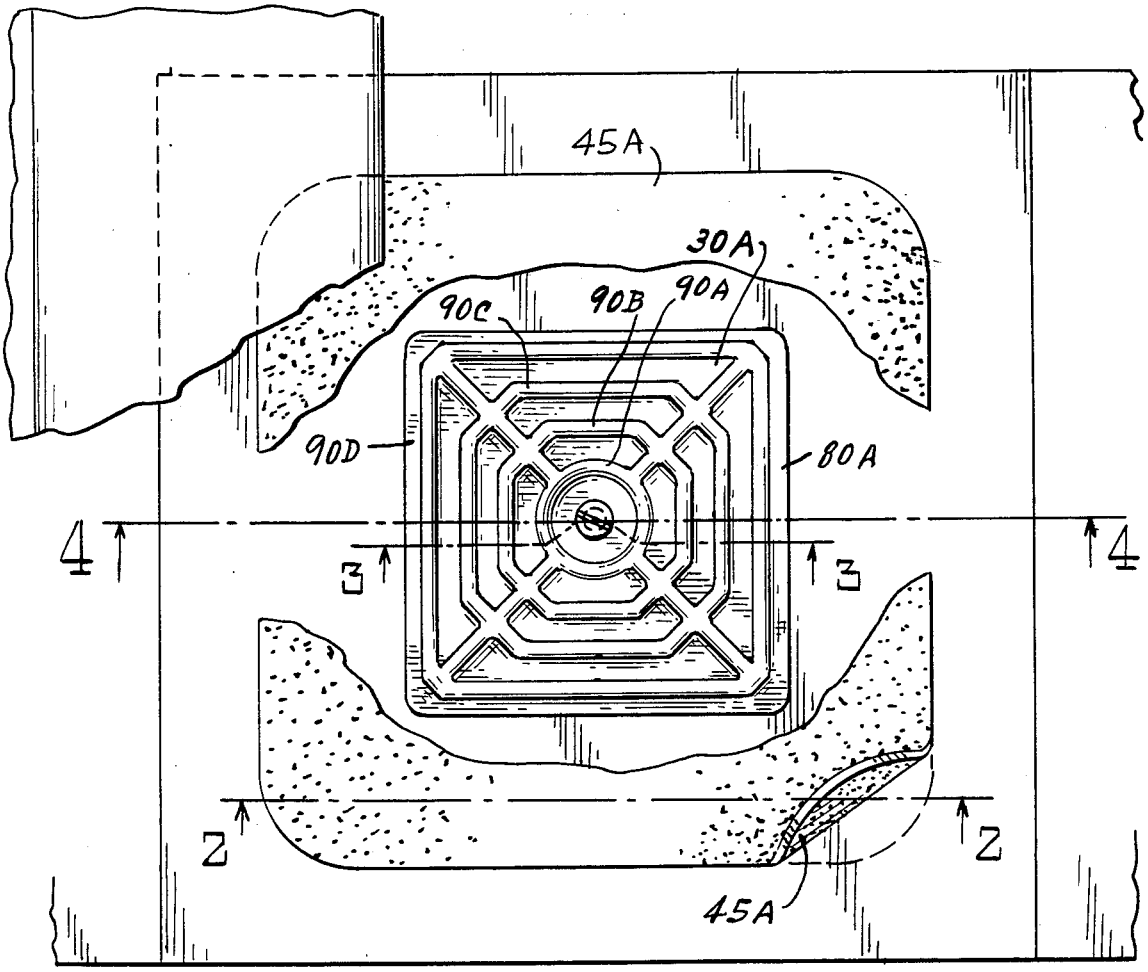
FIG. 1 is a top planar view of the fastening bonding plate arrangement utilizing the invention herein.
Figure 2:
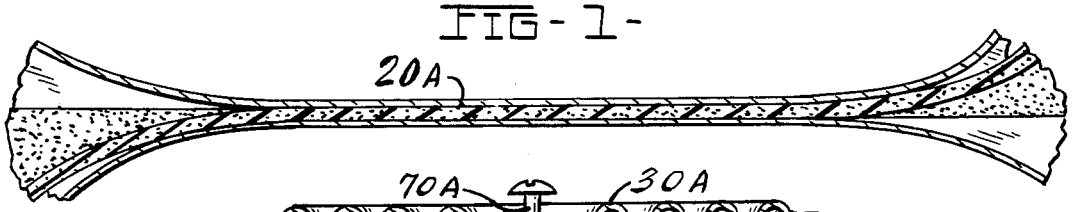
FIG. 2 is a side elevational view of the subject device shown with the upper covering, used to cover the adhesive, removed.
Figure 3:
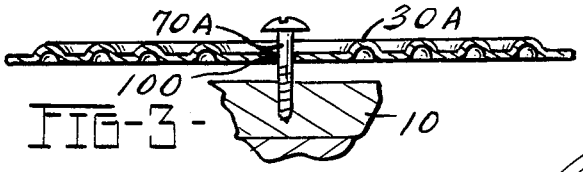
FIG. 3 is a side elevational view of the invention incorporating the subject invention.
Figure 4:
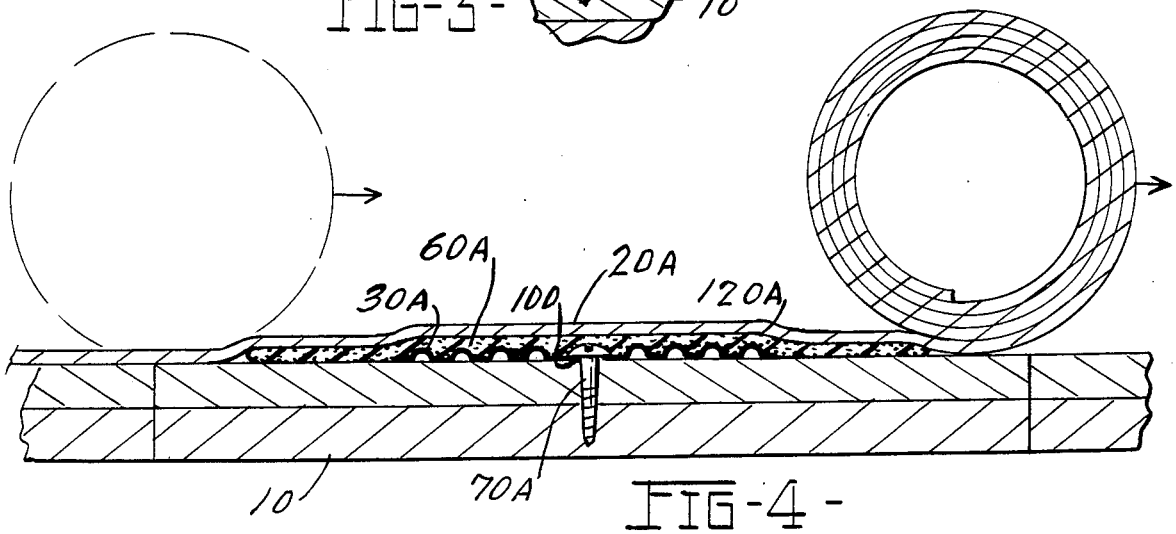
FIG. 4 is a side elevational view of the subject device incorporating the subject invention, showing how the bonding plate is affixed to a roof in the method where the bonding plate is affixed over the top of the rubber roof sheet.

Turning now to the drawing, the subject invention involves an apparatus and method to aid in the affixing of rubber roof sheets to a roof surface such as roof 10 shown in FIGS. 1 and 4. In this respect, the roof 10 is a horizontal, flat roof having perimeter edges not shown. Such roof is considered conventional in this regard, however, the subject invention can apply to a roof of any external configuration, whether rectangular, flat or other structural shape.

In the process of affixing rubber roof sheets to roof 10, the first step in the process is to lay, in a flush manner, a plurality of rectangular shaped rubber roof sheets, such as sheet 20A, shown in FIGS. 1 and 4, to the upper surface of the roof 10. As seen, the roofing sheet 20A is affixed in a regular grid-like pattern so that all such sheets cover the entire roof surface in a flush manner. Next, bonding plates 30A . . . are affixed over the upper surface of the rubber roof sheets 20A . . . once laid in the manner described above, and the bonding plates are generally affixed in a series of evenly-spaced rows and columns, in a similar grid pattern, as seen from an upper elevational view of FIG. 1. The next step is to remove from the upper surface of the bonding plate the protective covering 45A, as shown in FIG. 4, which protective covering is used to hold a layer of adhesive material over its bottom surface, as well as the upper surface of the bonding plate 30A . . . The subsequent step is to nail, screw or spike a suitable member 70A through the center hole 100 in the bonding plate 30A . . . so as to affix the bonding plate through to the roof 10, as seen in FIG. 4.

As stated previously, it is not critical to the subject invention that the bonding plates 30A . . . be affixed in a regular pattern, however, such a pattern is preferable in either a square, rectangular or diamond or other regularly shaped pattern. Particularly, in the preferred embodiment shown the bonding plates 30A . . . are spaced a horizontal distance from one another of several feet. These distances are considered optional and are not critical to the subject invention, however but are described and illustrated to demonstrate the matrix-like grid over which the bonding plates 30A . . . should be dispersed.

The bonding plates 30A . . . incorporating the subject invention are employed by placing them over the rubber roof sheet 20A since it is emplaced over the roof surface 10. By being so placed over the top of the rubber roof sheet 20A, the bonding plates 30A . . . cover only a portion of the rubber roof sheet, as shown in FIG. 1. Once so emplaced over the top of the rubber roof sheet 20A, the bonding plate 30A is nailed to the roof 10 through the rubber roof sheet 20A, as shown in FIG. 5. In the alternate arrangement the same process as described above is generally used, except that the bonding plates 30A, . . . are nailed to the upper surface of the roof 10, with the rubber roof sheets being laid over the upper surface of the bonding plates. In this latter arrangement the adhesive material 43A on the upper surface of the bonding plate adheres the lower surface of the rubber roof sheet to the bonding plate.

As shown, the bonding plate 30A is constructed and comprised in part of a rectangular plate base member 80A, preferably of square shape and of metallic composition with a plurality of ridges 90A, 90B, 90C and 90D of square shape formed concentrically around the center opening 100 in the plate 30A, as shown. Center opening 100 is adapted to receive a nail or screw 70A . . . to fasten the plate 30A . . . to the roof sheet 20A and the roof 10, as shown. Emplaced over the upper surface of such bonding plate base member 30A is adhesive material 60A with a peel-off covering 45A of identical configuration to the upper surface of the base plate 80A; and this covering 45A also has an adhesive material layering 120A on its lower surface.

In the preferred embodiment of the subject invention, this pre-applied adhesive substance 60A and 120A, on the plate 30A and lower surface of the covering layer 45A is melded to such respective surfaces for potential usage, as described. The pre-applied adhesive material is generally a permanent adhesive substance that can securely adhere the bonding plate 30A to the adjoining lower surface of the rubber roof sheet 20A, as such sheet is affixed over the upper surface of the bonding plate 130A once it is nailed to the rubber roofing sheet and roof. In the other embodiment shown in the drawings, the bonding plate 30A is affixed over top the rubber roofing sheet 20A, and once the bonding plate is nailed or secured to the upper surface of the rubber roofing sheet 20A and the roof 10, the covering 45A is removed from the upper surface of the bonding plate, which covering 45A with its lower adhesive surface 120A can be reapplied in a flush manner to the upper surface of the bonding plate 30A, once so affixed to the roof sheet 20A upper surface. The covering helps seal the bonding plate to optimize its sealing capacity.

I claim:

1. A bonding plate apparatus for facilitating the affixing of rubber roofing sheetings to the upper surface of roof surface comprising:

(a) a rectangularly shaped bonding plate having an upper surface and a lower surface having ridges on the upper surface of said bonding and said bonding plate having additional concentric radiating ridges extending from the center thereof overlapping said concentric ridges, with a center circular ridge in the middle of said bonding plate;

(b) removable covering means with an upper and lower surface adapted to be affixed in a flush manner to the upper surface of said bonding plate, with said covering means having an adhesive material on said upper surface.

2. A bonding plate apparatus for facilitating the affixing of rubber roofing sheeting to the upper surface of roof surface comprising:

(a) bonding plate having an upper surface and a lower surface, said bonding plate having a plurality of concentric ridges on the upper surface thereof, and wherein said concentric ridges on the upper surface of said bonding plate having additional radiating ridges extending from the center thereof overlapping said concentric ridges, with a center circular ridge in the middle of said bonding plate, said bonding plate being dispersed over the upper surface of the roof in a regular pattern of square diamond or other regular pattern over such upper roof surface;

(b) removable covering means with an upper and lower surface adapted to be affixed in a flush manner to the upper surface of said bonding plate, with said covering means having a first adhesive means on said lower surface;

(c) second adhesive means on the upper surface of said bonding plate,whereby a rubber roof sheet can be laid flush over the upper surface of said bonding plate so as to affix in a flush manner the lower surface of said rubber roof sheet to the upper surface of said bonding plate, wherein said second adhesive means is adapted to seat against the ridges on the upper surface of said bonding plate.

3. A bonding plate apparatus for facilitating the affixing of rubber roofing sheetings to the upper surface a roof surface comprising:

(a) a bonding plate having an upper surface and a lower surface, said bonding plate having a plurality of concentric ridges on the upper surface thereof, and wherein said ridges on the upper surface of said bonding having additional radiating ridges extending from the center thereof and overlapping said concentric ridges, with a center circular ridge in the middle of said bonding plate;

(b) removable covering means with an upper and lower surface, said covering means adapted to be affixed in a flush manner to the upper surface of said bonding plate, with said covering means having a first adhesive material on said lower surface of said covering means;

(c) second adhesive means on the upper surface of said bonding plate, whereby a rubber roof sheeting can be laid flush over the upper surface of said bonding plate so as to affix in a flush manner the lower surface of said rubber roof sheeting to the upper surface of said bonding plate.

* * * * *